US009872809B1

(12) United States Patent
Davis et al.

(10) Patent No.: US 9,872,809 B1
(45) Date of Patent: Jan. 23, 2018

(54) REUSABLE METAL CASKET

(71) Applicant: Vandor Corporation, Richmond, IN (US)

(72) Inventors: Gerald H. Davis, Fountain City, IN (US); Mary Ellen Davis, Fountain City, IN (US); Keith L. Davis, Fountain City, IN (US)

( * ) Notice: Subject to any disclaimer, the term of this patent is extended or adjusted under 35 U.S.C. 154(b) by 0 days.

(21) Appl. No.: 15/200,679

(22) Filed: Jul. 1, 2016

(51) Int. Cl.
*A61G 17/007* (2006.01)
*A61G 17/00* (2006.01)

(52) U.S. Cl.
CPC ..... *A61G 17/0076* (2013.01); *A61G 17/001* (2017.05)

(58) Field of Classification Search
CPC .... A61G 17/0076; A61G 17/00; A61G 17/02; A61G 17/04; A61G 17/001; A61G 17/028; A61G 17/034; A61G 17/0405
USPC ..... 27/2, 4, 6, 35
See application file for complete search history.

(56) References Cited

U.S. PATENT DOCUMENTS 3,133,334 A * 5/1964 Johnsen ..... A61G 17/04 27/27
3,613,189 A * 10/1971 Kirby ..... A61G 17/04 27/35
3,654,676 A * 4/1972 McHugh ..... A61G 17/00 27/2
3,810,282 A * 5/1974 Doggett ..... A61G 17/00 27/19
4,788,757 A * 12/1988 Bethune ..... A61G 17/00 27/12
6,324,737 B1 * 12/2001 Chamness ..... A61G 17/04 27/1
6,684,467 B1 * 2/2004 Walker ..... A61G 17/00 27/35
7,302,743 B2 * 12/2007 Fash ..... A61G 17/00 16/424
7,350,278 B2 * 4/2008 Davis ..... A61G 17/00 27/2
7,475,458 B1 * 1/2009 Gordon ..... A61G 17/02 27/35
7,698,792 B1 4/2010 Parker
8,127,414 B2 * 3/2012 Rankin ..... A61G 17/02 27/27
8,353,094 B2 1/2013 Parker
8,607,423 B2 * 12/2013 Davis ..... A61G 17/0073 27/12
8,661,633 B2 3/2014 Filipek et al.
8,789,250 B2 7/2014 Meiser et al.
8,914,953 B1 12/2014 Thacker
9,539,161 B2 * 1/2017 Davis ..... E05D 5/046
2014/0259574 A1 9/2014 Meiser et al.
2015/0290067 A1 10/2015 Drew et al.

* cited by examiner

*Primary Examiner* — William Miller
(74) *Attorney, Agent, or Firm* — Maginot, Moore & Beck LLP

(57) ABSTRACT

A reusable metal casket is configured to receive a tray supporting the deceased. The casket includes a base, having a head end, a first side, a second side, and a foot end, and a lid. The lid is rotatably coupled to the first side or the second side. The foot end is rotatable relative to a bottom of the casket to enable insertion and removal of the tray. The head end and the foot end include curved corners. Accordingly, the interfaces between the head end and the foot end and the first side and the second side are formed separately from the curved corners.

19 Claims, 8 Drawing Sheets

REUSABLE METAL CASKET

FIELD OF THE INVENTION

This application relates generally to caskets, and more particularly, to reusable caskets made of metal.

BACKGROUND

Caskets for burial and/or display of a deceased can be constructed from a plurality of materials, including wood, metal, and paper materials, as well as combinations of the foregoing. These caskets vary substantially in price, but metal-based caskets, in particular, can be expensive. Metal-based caskets are nevertheless desirable and preferred by many due to their particular aesthetic qualities. Accordingly, reusable metal caskets have been developed to facilitate use of a metal-based casket during funeral services and events without requiring the purchase of the metal-based casket. These reusable metal caskets receive a tray supporting the deceased for use in funeral services and events. The tray may thereafter be removed from the casket after the completion of services and events.

While reusable metal caskets allow for the use of a metal-based casket without requiring the purchase of the casket, there are some issues with existing reusable metal caskets. For example, reusable caskets require additional structures to facilitate the insertion and removal of the tray carrying the deceased. These additional structures can alter the appearance of the casket in an undesirable way. For example, it can be desirable to downplay the reusable nature of the metal casket. Thus, there is a need for a reusable metal casket that is as similar as possible in appearance to a conventional, non-reusable metal casket.

One factor contributing to the difference in appearance between reusable and non-reusable metal caskets is the weight of the metal components of the caskets. Because the metal components of metal-based caskets can be heavy, existing reusable metal caskets include additional support members and structures to enable securing the components of the casket to one another to form a sturdy casket. These additional support members not only add further weight to the casket, but they also impact the aesthetic appearance of the casket. Thus, there is a need for a reusable metal casket that is sturdy and secure but does not requiring additional components, which add weight and detract from the aesthetic appearance of the casket.

Another issue in reusable metal caskets relates to the connection of movable components to the stationary components. For example, specific portions of reusable metal caskets are often movable to enable the tray to be inserted and removed from the casket. The elements which fasten the movable portions to the stationary components of the casket and secure the movable portions in place relative to the stationary components must be easy to use, but also provide secure and sturdy interfaces so that the casket is secure and sturdy when in use and when being moved. Additionally, it is desirable to limit the movement of the movable portions to reduce damage to the casket or injury to the user by heavy metal components.

Another problem associated with reusable metal caskets relates to providing aesthetically pleasing interfaces between the sides and the ends of the casket. Not only is it desirable for the interfaces between the movable portions and the stationary components of the caskets to be secure and sturdy, but also to be aesthetically pleasing and as visually unobtrusive as possible.

SUMMARY

A reusable metal casket includes a base and a lid, both constructed primarily of a metal material. The base includes a bottom, a head end, a first side, a second side, and a foot end. The head end is fixedly coupled to the bottom and includes a head panel defining a substantially planar head panel surface. The first side is fixedly coupled to the bottom and to the head end. The first side includes a first side panel defining a first side surface that is substantially perpendicular to the head panel surface. Similarly, the second side is fixedly coupled to the bottom and to the head end, and the second side includes a second side panel defining a second side surface that is substantially parallel to the first side surface. The foot end is rotatably coupled to the bottom and includes a foot panel, a first foot portion, and a second foot portion. The foot panel defines a substantially planar foot panel surface, the first foot portion defines a substantially planar first foot portion surface, and the second foot portion defines a substantially planar second foot portion surface. The first and second foot portions project substantially perpendicularly from the foot panel such that the first and second foot portion surfaces are substantially perpendicular to the foot panel surface and parallel to the first and second side surfaces, respectively. The foot end is movable between a first position and a second position. When the foot end is in the first position, the foot panel surface is parallel to the head panel surface. When the foot end is in the second position, the foot panel surface is not parallel to the head panel surface. The lid is rotatably coupled to the second side.

In at least one embodiment, the first side includes a planar first side surface that is perpendicular to the head panel surface, and the second side includes a planar second side surface that is perpendicular to the head panel surface. The foot end includes a planar foot panel surface, a first foot portion surface, a second foot portion surface, a first curved surface, and a second curved surface. The first foot portion surface and the second foot portion surface are perpendicular to the foot panel surface, the first curved surface extends between the foot panel surface and the first foot portion surface, and the second curved surface extends between the foot panel surface and the second foot portion surface.

DETAILED DESCRIPTION

Figure 1A:
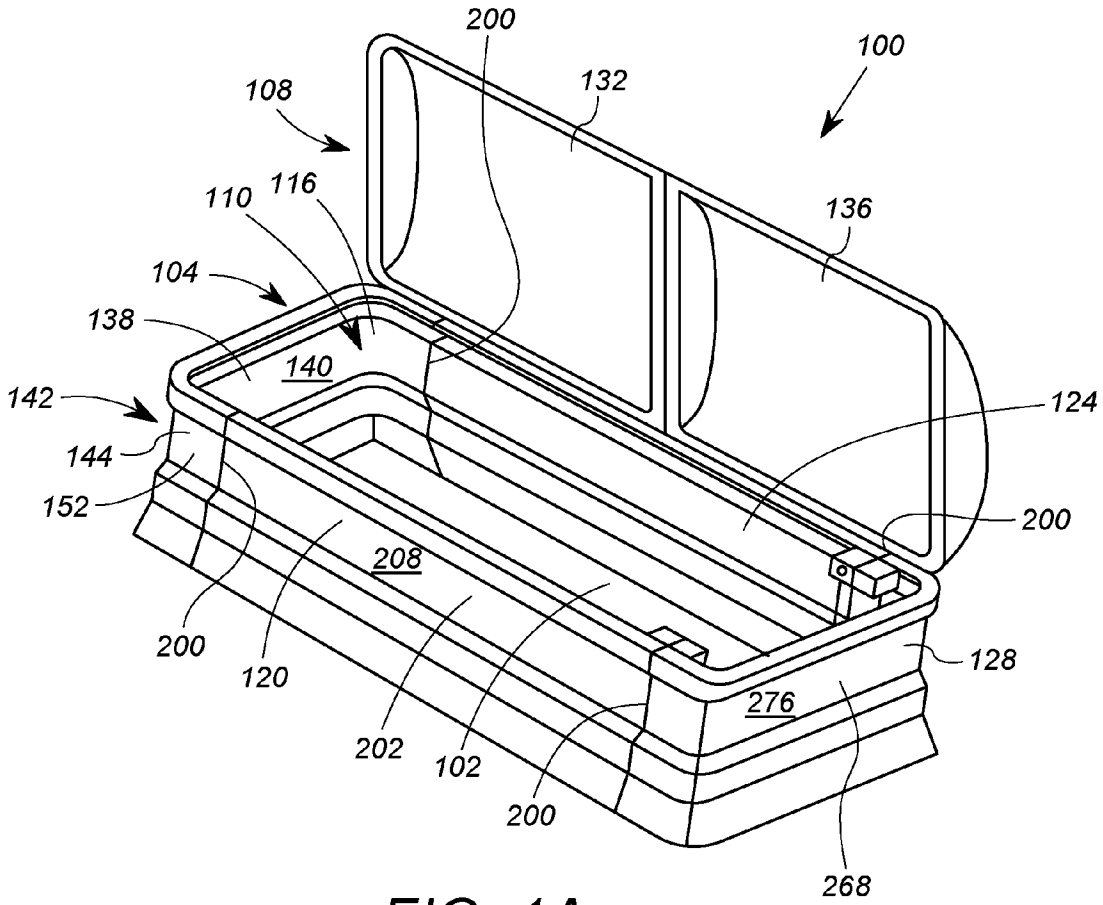
FIG. 1A depicts a perspective view of a tray received within a reusable metal casket, which is in a closed position.
Figure 1B:
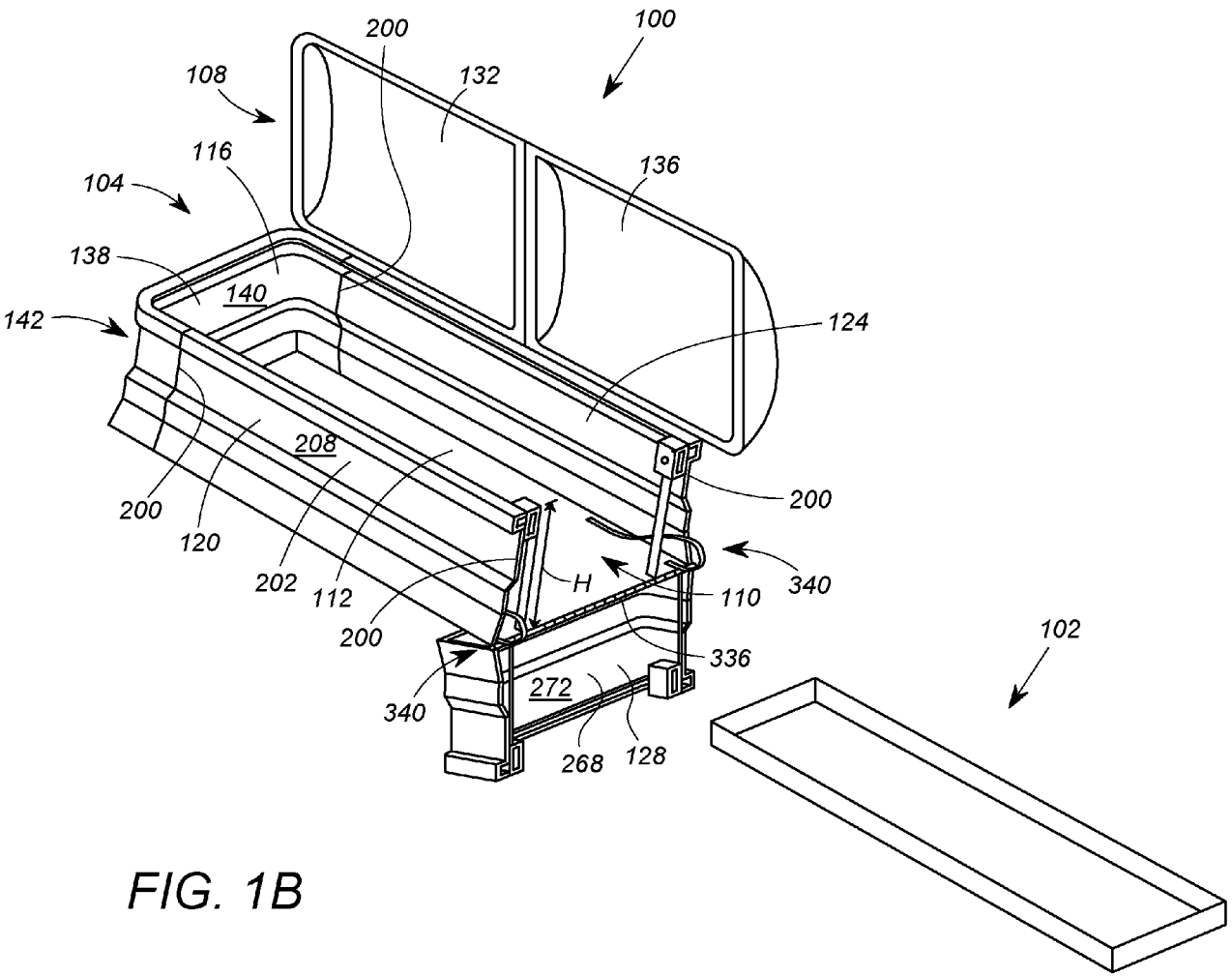
FIG. 1B depicts a perspective view of the tray and the reusable metal casket, which is in an open position, separated from one another.

As shown in FIGS. 1A and 1B, a reusable metal casket 100 is configured to removably receive a tray 102 supporting a body of the deceased. The casket 100 includes a base 104 and a lid 108, each of which is made of a metal material. The base 104 includes a bottom 112 (only visible in FIG. 1B), a head end 116, a first side 120, a second side 124, and a foot end 128, which is rotatably coupled to the bottom 112. The lid 108 includes a head portion 132 and a foot portion 136, which are both rotatably coupled to the second side 124. In an alternative embodiment, the head portion 132 and the foot portion 136 of the lid 108 can be rotatably coupled to the first side 120 instead of the second side 124. The head portion 132 and the foot portion 136 of the lid 108 rotate relative to the second side 124 to open and close the casket 100, in a manner known in the art. The base 104 and the lid 108 enclose an interior 110 of the casket 100. When the tray 102 is received within the casket interior 110 (as shown in FIG. 1A), the tray 102 is supported by the bottom 112 and fits between the head end 116 and foot end 128 and between the first side 120 and second side 124. When the lid 108 is closed, the lid 108 covers the tray 102.

To form the base 104, the head end 116 is fixedly coupled to the bottom 112, the first side 120 and the second side 124 are fixedly coupled to the bottom 112 and to the head end 116, and the foot end 128 is rotatably coupled to the bottom 112. Each of the first and second sides 120, 124 and the head and foot ends 116, 128 projects from the bottom 112 by a height H, such that the base 104 has the height H. The first side 120 and the second side 124 of the base 104 are coupled to opposite sides of the bottom 112 and are arranged parallel to one another. Similarly, the foot end 128 and the head end 116 are coupled to opposite sides of the bottom 112. The foot end 128 is rotatable between a first position (shown in FIG. 1A), whereat the foot end 128 is opposite and parallel to the head end 116, and a second position (shown in FIG. 1B), whereat the foot end 128 is not opposite and parallel to the head end 116. When the foot end 128 is in the first position, the tray 102 is securely retained in the casket interior 110. When the foot end 128 is in the second position, the tray 102 can be inserted and removed from the casket interior 110 by sliding the tray 102 in a direction parallel to the first side 120 and the second side 124.

The head end 116 of the base 104 includes a head panel 138, which is substantially planar and is arranged substantially perpendicularly to the bottom 112. The head panel 138 defines a head panel inward surface 140, which faces toward the foot end 128 and the casket interior 110, and a head panel outward surface 142, which is opposite the head panel inward surface 140. The head panel outward surface 142 is indicated by an arrow, but is not visible, in FIGS. 1A and 1B.

Figure 2:
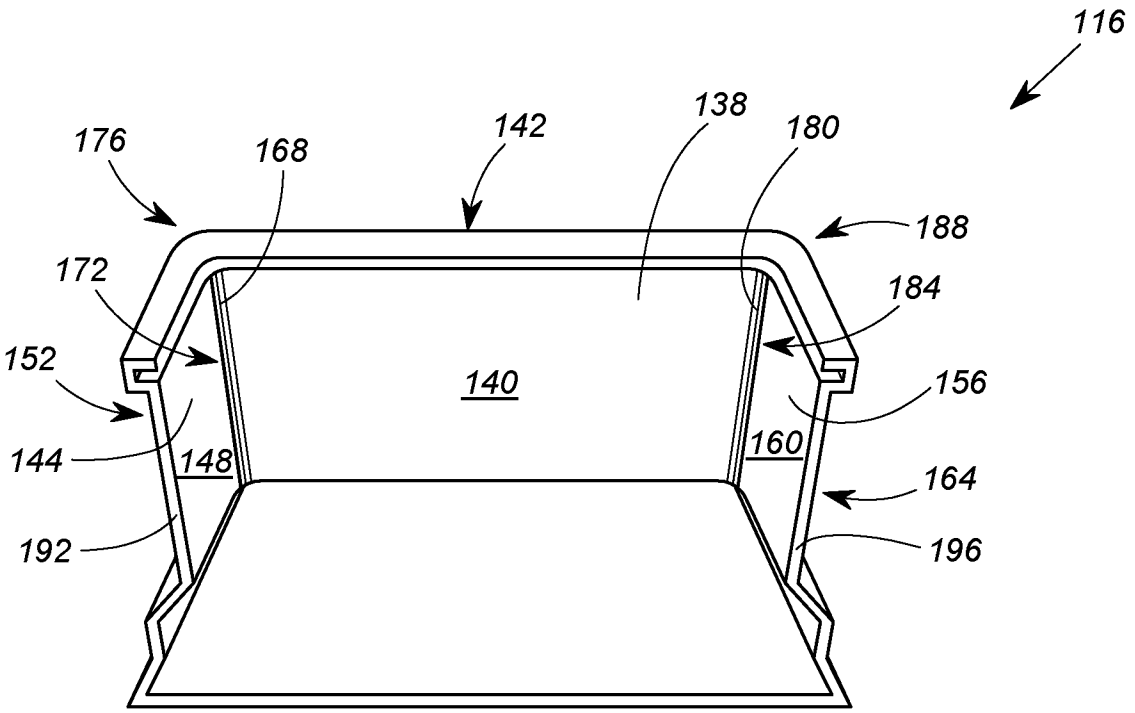
FIG. 2 depicts a perspective view of a head end of the reusable metal casket of FIGS. 1A and 1B.

As shown in more detail in FIG. 2, the head end 116 further includes a first head portion 144 and a second head portion 156, and a first head curve 168 and a second head curve 180. The first head portion 144 and the second head portion 156 are substantially planar and substantially identical to one another. The first head portion 144 and the second head portion 156 project substantially perpendicularly from the head panel 138 such that the first head portion 144 extends toward the first side 120 and the second head portion 156 extends toward the second side 124, and the first and second head portions 144, 156 are substantially perpendicular to the bottom 112.

The first head portion 144 defines a first head portion inward surface 148, which faces toward the casket interior 110 (shown in FIGS. 1A and 1B), and a first head portion outward surface 152, which is opposite the first head portion inward surface 148 and faces away from the casket interior 110. Similarly, the second head portion 156 defines a second head portion inward surface 160, which faces toward the first head portion inward surface 148 and the casket interior 110, and an opposite second head portion outward surface 164. The first head portion outward surface 152 and the second head portion outward surface 164 are indicated with arrows, but are not visible in FIG. 2. Thus, the first head portion inward surface 148 and the second head portion inward surface 160 face toward one another. When the first side 120 and the second side 124 are coupled to the head end 116, the first head portion 144 is aligned with the first side 120 and the second head portion 156 is aligned with the second side 124, as described in more detail below.

The first head portion 144 further defines a first head edge surface 192, and the second head portion 156 further defines a second head edge surface 196. The first and second head edge surfaces 192, 196 are parallel to one another and parallel to the head panel inward surface 140. The first head edge surface 192 extends perpendicularly between the first head portion inward surface 148 and the first head portion outward surface 152 and abuts the first side 120 when the first side 120 is fixedly coupled to the bottom 112 and to the head end 116. Similarly, the second head edge surface 164 extends perpendicularly between the second head portion inward surface 160 and the second head portion outward surface 164 and abuts the second side 124 when the second side 124 is fixedly coupled to the bottom 112 and to the head end 116.

As noted above, the head end 116 further includes the first head curve 168 and the second head curve 180, which are substantially identical to one another and mirror one another on opposite sides of the head panel 138. The first head curve 168 extends between the head panel 138 and the first head portion 144, and the second head curve 180 extends between the head panel 138 and the second head portion 156. Accordingly, the first head edge surface 192 is spaced apart from the head panel inward surface 140 by the first head curve 168 and the first head portion 144, and the second head edge surface 196 is spaced apart from the head panel inward surface 140 by the second head curve 180 and the second head portion 156.

The first head curve 150 defines a first head curve inward surface 172, which faces toward the interior 110 of the casket 100, and an opposite first head curve outward surface 176. Similarly, the second head curve 180 defines a second head curve inward surface 184, which faces toward the interior 110 of the casket 100, and an opposite second head curve outward surface 188. The first head curve outward surface 176 and the second head curve outward surface 188 are indicated with arrows, but are not visible in FIG. 2.

The first head curve inward surface 172 provides a smoothly curved transition between the first head portion inward surface 148 and the head panel inward surface 140, which are arranged perpendicularly to one another. In the same way, the first head curve outward surface 176 provides a smoothly curved transition between the first head portion outward surface 152 and the head panel outward surface 142, the second head curve inward surface 184 provides a smoothly curved transition between the second head portion inward surface 160 and the head panel inward surface 140, and the second head curve outward surface 188 provides a smoothly curved transition between the second head portion outward surface 164 and the head panel outward surface 142. These smoothly curved transitions provide the metal casket 100 with a desirable aesthetic as well as preventing damage to the casket 100 or other objects if the casket 100 inadvertently contacts other objects during movement and use. Because the casket 100 is made of a metal material, smoothly curved transitions also prevent the casket 100 from having sharp metal corners.

As shown in FIGS. 1A and 1B, seams 200 are formed on the casket 100 where the first head edge surface 192 and the second head edge surface 196 (shown in FIG. 2) abut the first side 120 and the second side 124, respectively. Because the first head edge surface 192 and the second head edge surface 196 are parallel to the head panel inward surface 140 and spaced apart from the head panel inward surface 140, the seams 200 are spaced apart from the head panel 138 and the first head curve 168 and the second head curve 180. This positioning of the seams 200 enhances the aesthetic of the casket 100 because the first and second head curves 168, 180 are uninterrupted. Additionally, this positioning of the seams 200 enables strong interfaces between the head end 116 and the first and second sides 120, 124 because the interfaces are not formed in curves. The first head portion 144 extends from the seam 200 formed at the first head edge surface 192 to the first head curve 150, and the second head portion 156 extends from the seam 200 formed at the second head edge surface 196 to the second head curve 180.

With continued reference to FIGS. 1A and 1B, the first side 120 and the second side 124 of the base 104 are substantially identical to one another and mirror one another on opposite sides of the bottom 112. As shown in more detail in FIG. 3, the first side 120 includes a first side panel 202 defining a first side panel inward surface 204, which faces toward the casket interior 110, and an opposite first side panel outward surface 208. The first side panel outward surface 208 is indicated with an arrow, but is not visible in FIG. 3. The first side panel 202 further defines a first side edge surface 212 extending between the first side panel inward surface 204 and the first side panel outward surface 208. Thus, the first side edge surface 212 is also parallel to the head panel inward surface 140 and the first head edge surface 192 (shown in FIG. 2). The first side edge surface 212 extends along the entire height H of the first side 120. When the first side 120 is coupled to the head end 116, the first side edge surface 212 is arranged parallel to the first head edge surface 192, but facing toward the foot end 128. Additionally, the first head portion 144 is aligned with the first side 120 such that the first side panel inward surface 204 is coplanar with the first head portion inward surface 148 (shown in FIG. 2) and the first side panel outward surface 208 is coplanar with the first head portion outward surface 152 (shown in FIG. 2). Accordingly, when the first side 120 is coupled to the head end 116, a smooth transition is formed at the seam 200 (shown in FIGS. 1A and 1B) where the first side 120 abuts the head end 116.

Similarly, the second side 124 includes a second side panel 216 defining a second side panel inward surface 220, a second side panel outward surface 224, and a second side edge surface 228. Like the first side edge surface, 212, the second side edge surface 228 extends along the entire height H of the second side 124. When the second side 124 is coupled to the head end 116, the second side edge surface 228 is arranged parallel to the second head edge surface 196 (shown in FIG. 2), but facing toward the foot end 128. Additionally, the second head portion 156 is aligned with the second side 124 such that the second side panel inward surface 220 is coplanar with the second head portion inward surface 160 (shown in FIG. 2), and the second side panel outward surface 224 is coplanar with the second head portion outward surface 164 (shown in FIG. 2). Accordingly, when the second side 124 is coupled to the head end 116, a smooth transition is formed at the seam 200 (shown in FIGS. 1A and 1B) where the second side 124 abuts the head end 116.

Each of the first and second sides 120, 124 further includes an engagement element 232 configured to engage with the foot end 128, as described in more detail below. As shown in more detail in FIGS. 4A and 4B, each of the engagement elements 232 includes a frame 236 and an operating element, for example, a hook 240, rotatably coupled to the frame 236. Each of the frames 236 is fixedly coupled to the respective one of the first and second side panel inward surfaces 204, 220 (shown in FIG. 3), and includes an open side 244, which is parallel to the respective of the first and second side edge surfaces 212, 228 (shown in FIG. 3). Each of the hooks 240 includes a tip 248 and is rotatable between an unengaged position (shown in FIG. 4A), whereat the tip 248 is positioned entirely within the frame 236, and an engaged position (shown in FIG. 4B), whereat the tip 248 projects through the open side 244 and is partially positioned outside of the frame 236.

Each of the hooks 240 is manually rotatable between the unengaged and the engaged positions by, for example, engaging an opening 252 in the hook 240 with a key, which is then rotated to rotate the hook 240. In the embodiment shown, the frame 236 also includes an opening 256 (shown in FIG. 3) aligned with the hook opening 252 to enable engagement of the hook opening 252 from outside the frame 236. In the embodiment shown, the frame opening 256 is arranged on a side of the frame 236 which is opposite the respective of the first and second side panel inward surfaces 204, 220 to enable engagement of the hook opening 252 from the casket interior 110. Thus, the hook 240 is engageable by inserting a key into the frame opening 256 and the hook opening 252 from within the casket 100. As described in more detail below, each of the hooks 240 is rotated to enable the tip 248 to selectively engage with the foot end 128 to couple the foot end 128 to the first and second sides 120, 124 when the foot end 128 is in the first position. In alternative embodiments, the operating element can be an element other than a hook 240 that is configured to selectively engage with the foot end 128.

Returning to FIG. 3, each of the first and second sides 120, 124 further includes a rail 260 extending from the frame 236 of the engagement element 232 to the bottom 112 of the base 104. The rail 260 is coupled to both the frame 236 and the bottom 112 by, for example, welding. Each of the rails 260 includes a further side surface 264, which is parallel to and faces toward the respective of the first and second side panel inward surfaces 204, 220. In other words, the further side surfaces 264 face away from each other. The further side surfaces 264 are indicated with arrows, but are not visible in FIG. 3. As described in more detail below, the rails 260 are arranged such that a portion of the foot end 128 is received between the further side surfaces 264 and the respective of the first and second side panel inward surfaces 204, 220 when the foot end 128 is in the first position.

Figure 5:
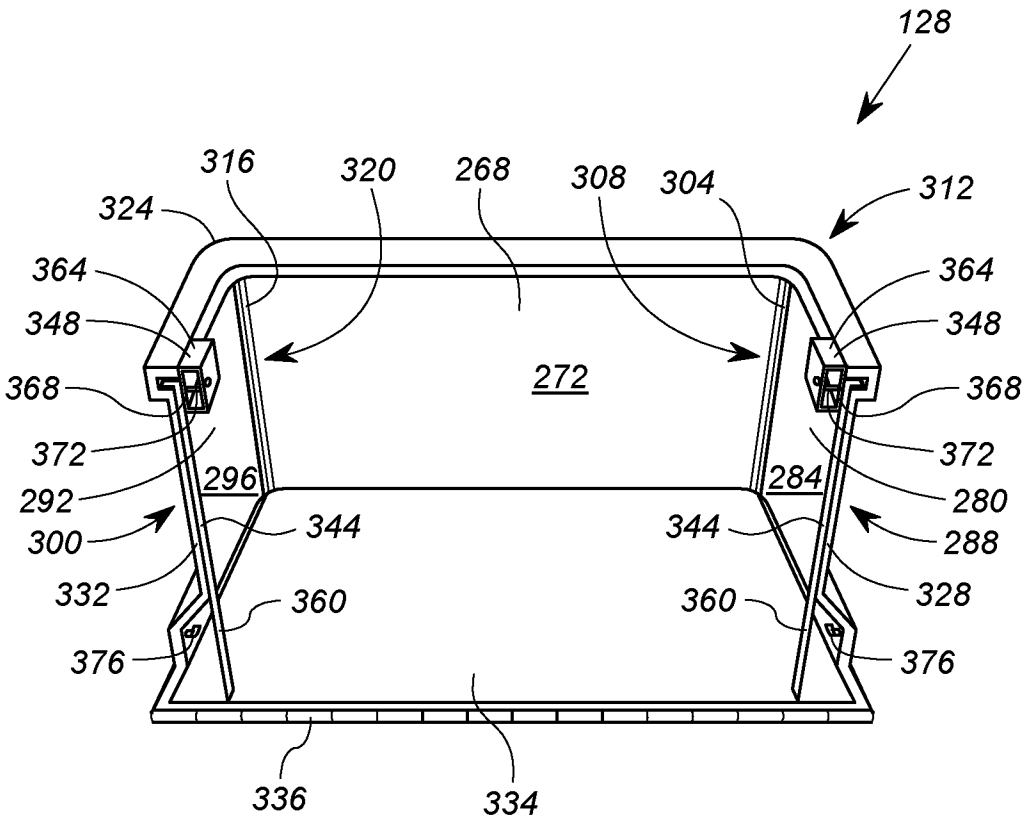
FIG. 5 depicts a perspective view of the foot end of the reusable metal casket of FIGS. 1A and 1B.

As shown in FIG. 5, the foot end 128 is substantially similar to the head end 116, described above and shown in FIG. 2. The foot end 128 generally mirrors the head end 116 on the opposite side of the bottom 112. In particular, the foot end also includes a foot panel 268, which defines a foot panel inward surface 272 and an opposite foot panel outward surface 276 (shown in FIG. 1A). When the foot end 128 is in the first position, as shown in FIG. 1A, the foot panel inward surface 272 is parallel to the head panel inward surface 140 and faces toward the casket interior 110, and the foot panel outward surface 276 is parallel to the head panel inward surface 140 and faces away from the casket interior 110.

Like the head end 116, the foot end 128 also includes a first foot portion 280, which defines a first foot portion inward surface 284, a first foot portion outward surface 288, and a first foot edge surface 328 extending perpendicularly between the first foot portion inward surface 284 and the first foot portion outward surface 288. The foot end 128 also includes a second foot portion 292, which defines a second foot portion inward surface 296, a second foot portion outward surface 300, and a second foot edge surface 332 extending perpendicularly between the second foot portion inward surface 296 and the second foot portion outward surface 300. The first foot portion outward surface 288 and the second foot portion outward surface 300 are indicated with arrows, but are not visible in FIG. 5. The first foot edge surface 328 and the second foot edge surface 332 extend along an entirety of the height H of the foot end 128.

The first foot portion 280 and the second foot portion 292 project substantially perpendicularly from the foot panel 268 such that the first foot portion inward surface 284 and the second foot portion inward surface 296 are parallel to one another and face toward one another. Additionally, the first and second foot portion inward surfaces 284, 296 are substantially parallel to the first and second side panel inward surfaces 204, 220. The first foot edge surface 328 and the second foot edge surface 332 are parallel to one another and parallel to the foot panel inward surface 272. Additionally, when the foot end 128 is in the first position, the first and second foot edge surfaces 328, 332 face toward the first and second side edge surfaces 212, 228 (shown in FIG. 3), respectively. The first and second foot edge surfaces 328, 332 are separated from one another by the foot panel 268.

Also like the head end 116, the foot end 128 further includes a first foot curve 304, which includes a first foot curve inward surface 308 and a first foot curve outward surface 312, and a second foot curve 316, which includes a second foot curve inward surface 320 and a second foot curve outward surface 324. The first foot curve outward surface 312 and the second foot curve outward surface 324 are indicated by arrows, but are not visible in FIG. 5.

The first and second foot curves 304, 316 are arranged between the foot panel 268 and the first and second foot portions 280, 292, respectively, so as to form smoothly curved transitions between the foot panel 268 and the first and second foot portions 280, 292. Accordingly, in the same manner as described above with respect to the head end 116, the first foot curve inward and outward surfaces 308, 312 form smoothly curved transitions between the foot panel inward and outward surfaces 272, 276 and the first foot portion inward and outward surfaces 284, 288, and the second foot curve inward and outward surfaces 320, 324 form smoothly curved transitions between the foot panel inward and outward surfaces 272, 276 and the second foot portion inward and outward surfaces 296, 300.

As shown in FIGS. 1A and 1B, seams 200 are formed on the casket 100 where the first foot edge surface 328 and the second foot edge surface 332 (shown in FIGS. 3 and 5) abut the first side edge surface 212 and the second side edge surface 228, respectively. Because the first foot edge surface 328 and the second foot edge surface 332 are parallel to the foot panel inward surface 272 and spaced apart from the foot panel inward surface 272, the seams 200 are spaced apart from the foot panel 268 and the first and second foot curves 304, 316. This positioning of the seams 200 enhances the aesthetic of the casket 100 because the first and second foot curves 304, 316 are uninterrupted. Additionally, this positioning of the seams 200 enables strong interfaces between the foot end 128 and the first and second sides 120, 124 because the interfaces are not formed in curves. The first foot portion 280 extends from the seam 200 formed at the first foot edge surface 328 to the first foot curve 304, and the second foot portion 292 extends from the seam 200 formed at the second foot edge surface 332 to the second foot curve 316.

Returning to FIG. 1B, the casket 100 further includes at least one hinge 336 and at least two biasing arrangements 340, which rotatably couple the foot end 128 to the bottom 112 of the base 104. In other words, the foot end 128 is coupled to the bottom 112 via the at least one hinge 336 and the biasing arrangements 340. The hinge 336 is configured to enable the foot end 128 to rotate relative to the bottom 112 between the first position (shown in FIG. 1A) and the second position (shown in FIG. 1B). The hinge 336 can include, for example, a piano hinge or a barrel hinge to enable secure attachment of the foot end 128 to the bottom 112, facilitate smooth rotation of the foot end 128 relative to the bottom 112, and reduce the likelihood of objects becoming accidentally caught in the hinge 336 and between the foot end 128 and the bottom 112. As further illustrated in FIG. 3, the hinge 336 is arranged at the edge where the foot end 128 meets the bottom 112 to enable the foot end 128 to rotate relative to the bottom 112 about the hinge 336. As described in more detail below, the biasing arrangements 340 are coupled to both the bottom 112 and the foot end 128 and are configured to limit the range of rotation of the foot end 128 relative to the bottom 112.

As shown in FIG. 5, foot end 128 includes a bottom portion 334, which is perpendicular to the foot panel 268 and is arranged so as to be substantially coplanar with the bottom 112 of the base 104 when the foot end 128 is in the first position. The foot end 128 also includes a biasing member hook 376 coupled to the first foot portion inward surface 284 of the first foot portion 280 and a biasing member hook 376 coupled to the second foot portion inward surface 296 of the second foot portion 292. Each of the biasing member hooks 376 is part of a biasing arrangement 340, described in more detail below. The biasing member hooks 376 can be made of, for example, steel, and can be welded to the first and second foot portion inward surfaces 284, 296.

Figure 7A:
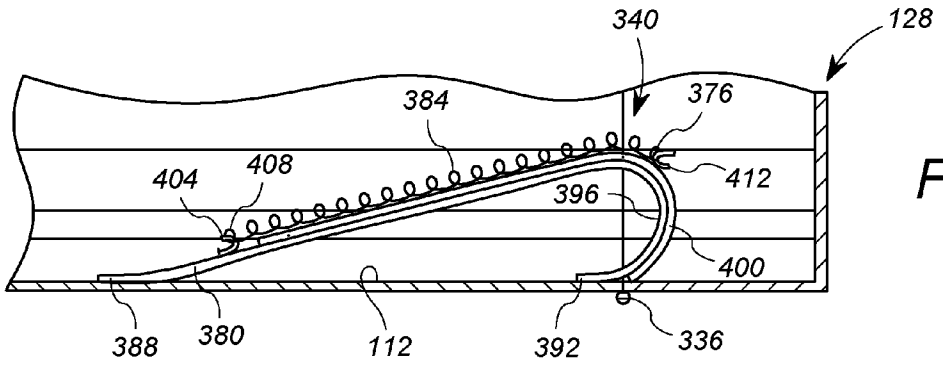
FIG. 7A depicts a cross-sectional view of a portion of the reusable metal casket of FIGS. 1A and 1B in the closed position.
Figure 7B:
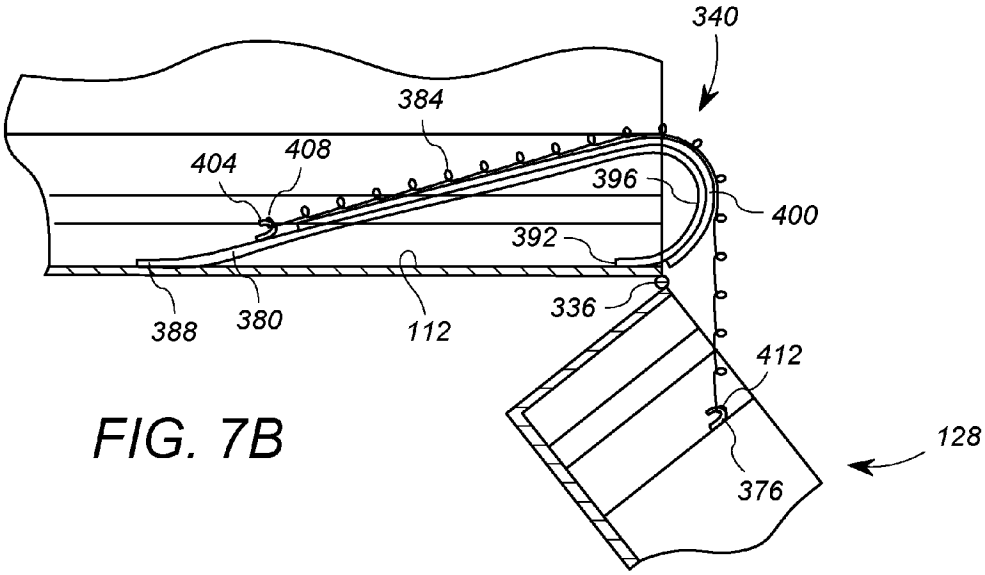
FIG. 7B depicts a cross-sectional view of a portion of the reusable metal casket of FIGS. 1A and 1B in the open position.

FIGS. 7A and 7B depict a cross-sectional view of a portion of the casket 100 in the open position (FIG. 7A) and the closed position (FIG. 7B) to illustrate the biasing arrangement 340. For clarity, only one biasing arrangement 340 is shown in FIGS. 7A and 7B. However, because the structure and function of both biasing arrangements 340 is the same, the description of one biasing arrangement 340 applies to both biasing arrangements 340 shown in FIGS. 1B and 3.

As shown in FIGS. 7A and 7B, the biasing arrangement 340 includes a ramp 380 and a spring member 384. The ramp 380 can be made of, for example, steel, and the spring member 384 can be, for example, a coil spring. The ramp 380 includes a first end 388, which is coupled to the bottom 112, a second end 392, which is also coupled to the bottom 112, and a curve 396 interposed between the first end 388 and the second end 392. The ramp 380 further includes a damper 400 and a ramp hook 404, each of which is coupled to the ramp 380 opposite the bottom 112. The ramp hook 404 is coupled to the ramp 380 at a position near the first end 388, and the damper 400 is coupled to the ramp 380 so as to follow the contour of the ramp 380 from a position near the ramp hook 404, over the curve 396, and to a position near the second end 392 of the ramp 380. The damper 400 can be made of, for example, vinyl or another non-metal material which can be coupled to the ramp 380 so as to follow the contour of the ramp 380. The ramp hook 404 can be made of, for example, steel, and can be welded to the ramp 380.

The spring member 384 includes a first end 408, which is coupled to the ramp hook 404, and a second end 412, which is coupled to a corresponding one of the biasing member hooks 376 on the foot end 128. The spring member 384 can include a loop or another feature at each of the first and second ends 408, 412 to enable the spring member 384 to be uncoupled and removed from the biasing member hook 376 and/or the ramp hook 404. Removing the spring member 384 facilitates replacement of the spring member 384 if desired. However, the spring member 384 and the biasing member hook 376 and ramp hook 404 are configured such that the spring member 384 is not unintentionally uncoupled from the biasing member hook 376 and/or ramp hook 404.

The spring member 384 follows the contour of the ramp 380 from the ramp hook 404 over a portion of the curve 396. As shown in FIG. 7A, when the foot end 128 is in the first position, the spring member 384 extends over a smaller portion of the curve 396 of the ramp 380, because the biasing member hook 376 on the foot end 128 is positioned near the ramp 380. In contrast, as shown in FIG. 7B, when the foot end 128 is in the second position, the spring member 384 is stretched to extend over a larger portion of the curve 396 of the ramp 380, because the biasing member hook 376 on the foot end 128 is positioned farther from the ramp 380. Accordingly, the spring member 384 is configured to bias the foot end 128 toward the first position and limit the degree to which the foot end 128 rotates relative to the bottom 112.

By limiting the degree of rotation of the foot end 128 relative to the bottom 112, the biasing arrangement 340 prevents the foot end 128 from swinging loosely and contacting the bottom 112, when in the second position, to prevent damaging the casket 100, making a loud noise, or injuring a user. Additionally, the biasing arrangement 340 facilitates returning the foot end 128 to the first position.

The damper 400 is positioned such that the spring member 384 only rests on the damper 400 as the spring member 384 follows the contour of the ramp 380 from the ramp hook 404 over a portion of the curve 396. Accordingly, when the spring member 384 is expanded and contracted during movement of the foot end 128 between the first and second positions, the damper 400 prevents contact between the spring member 384 and the ramp 380. Because the damper 400 is made of a non-metal material, the damper 400 prevents a loud noise, which would otherwise result from the movement of the spring member 384 in contact with the ramp 380.

In at least one embodiment, the biasing arrangements 340 are configured to limit the rotation of the foot end 128 to a range of between 90° and 270° relative to the bottom 112 such that, when the foot end 128 is in the second position, the foot panel 268 is between a position wherein the foot panel inward surface 272 is perpendicular to the bottom 112 and facing the casket interior 110 and a position wherein the foot panel inward surface 272 is perpendicular to the bottom 112 and facing outside of the casket 100. In at least one alternative embodiment, the biasing arrangements 340 are configured to limit the rotation of the foot end 128 to a range of between 90° and 180°, such that, when the foot end 128 is in the second position, the foot panel 268 is between a position wherein the foot panel inward surface 272 is perpendicular to the bottom 112 and facing the casket interior 110 and a position wherein the foot panel inward surface 272 is substantially parallel to the bottom 112. It is also possible to configure the biasing arrangements 340 to limit the rotation of the foot end 128 to other angular ranges relative to the bottom 112.

Figure 3:
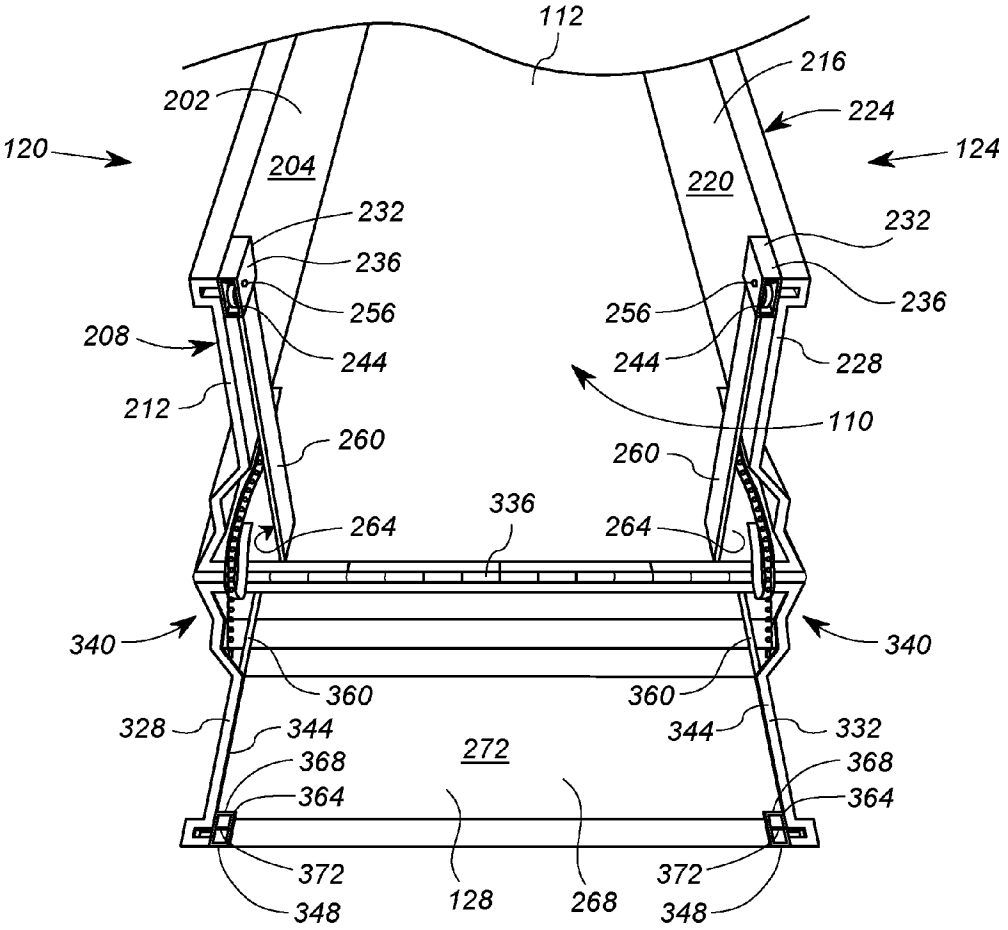
FIG. 3 depicts a perspective view of a foot end and portions of a first side and a second side of the reusable metal casket of FIGS. 1A and 1B.
Figure 4B:
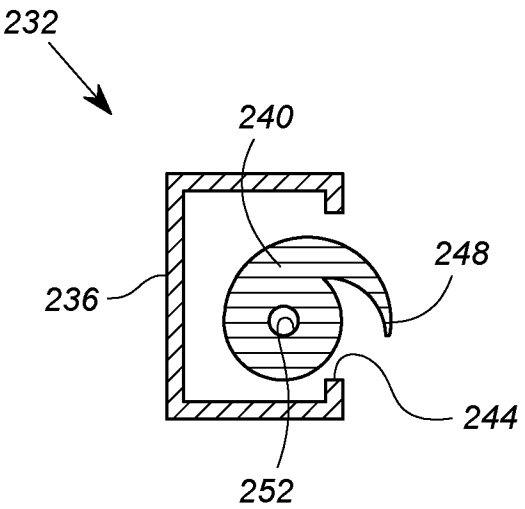
FIG. 4B depicts a cross-sectional view of the engagement element of FIG. 4A in an engaged position.
Figure 4A:
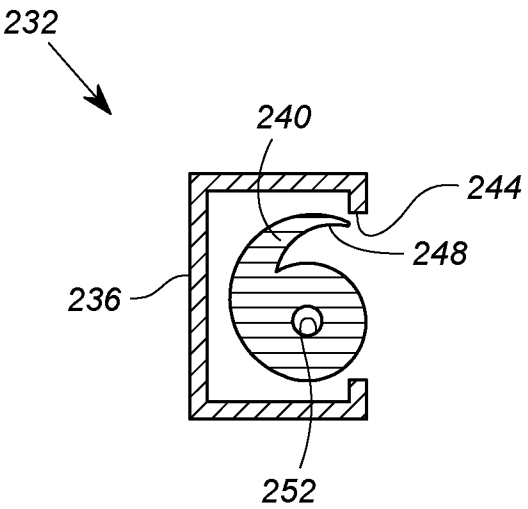
FIG. 4A depicts a cross-sectional view of an engagement element of one of the first and second sides of the reusable metal casket of FIGS. 1A and 1B in an unengaged position.

As shown in FIGS. 3 and 5, the foot end 128 further includes a fin 344 and a mating engagement element 348 arranged on each of the first foot portion 280 and the second foot portion 292. The fin 344 and the mating engagement element 348 on the first and second foot portions 280, 292 are substantially similar to one another. Accordingly, only the fin 344 and mating engagement element 348 on the first foot portion 280 are described in detail. However, the same description also applies to the fin 344 and mating engagement element 348 on the second foot portion 292.

The fin 344 projects from the first foot portion inward surface 284 and follows the contour of the first foot edge surface 328. Accordingly, the fin 344 is coplanar with the first foot portion inward surface 284, and is parallel to and inwardly offset from the first foot portion outward surface 288. The fin 344 further includes a fin support 360, which projects from the fin 344 and is perpendicular to the bottom portion 334. In other words, the fin support 360 is integrally formed with the fin 344, but instead of following the contour of the first foot edge surface 328, the fin support 360 extends straight to the bottom portion 334.

The fin 344 and the fin support 360 of the first foot portion 280 are configured to be received between the first side panel 202 and the corresponding rail 260 when the foot end 128 is in the first position. More specifically, when the foot end 128 is in the first position, the first foot edge surface 328 abuts the first side edge surface 212, and the fin 344 and the fin support 360 are received between the first side panel inward surface 204 and the further side surface 264 of the rail 260. Because the fin 344 follows the contour of the first foot edge surface 328, the fin 344 is parallel to an entirety of the first side panel inward surface 204. Similarly, because the fin support 360 extends perpendicular to the bottom portion 334 of the foot end 128, the fin support 360 is parallel to the rail 260.

As noted above, the foot end 128 also includes a similar fin 344 and fin support 360 on the second foot portion 292. Accordingly, the similarity in shapes and arrangements of the fins 344 and fin supports 360 relative to the first and second side panels 202, 216 and corresponding rails 260 enables the fins 344 and fin supports 360 of the foot end 128 to be securely received by the first and second side panels 202, 216 and rails 260 of the first and second sides 120, 124. This secure reception facilitates aligning the foot end 128 with the first and second sides 120, 124 and coupling the foot end 128 to the first and second sides 120, 124 in the first position. Furthermore, the secure reception reduces unintentional movement of the foot end 128 relative to the first and second sides 120, 124.

The mating engagement element 348 on the first foot portion 280 is fixedly coupled to the fin 344 within the casket interior 110 such that the mating engagement element 348 is aligned with the engagement element 232 of the first side 120 when the foot end 128 is in the first position. The mating engagement element 348 includes a frame 364 having an open side 368 that is parallel to the first foot edge surface 328. The mating engagement element 348 further includes a pin 372 spanning the open side 368 and arranged parallel to the first foot edge surface 328.

Figure 6B:
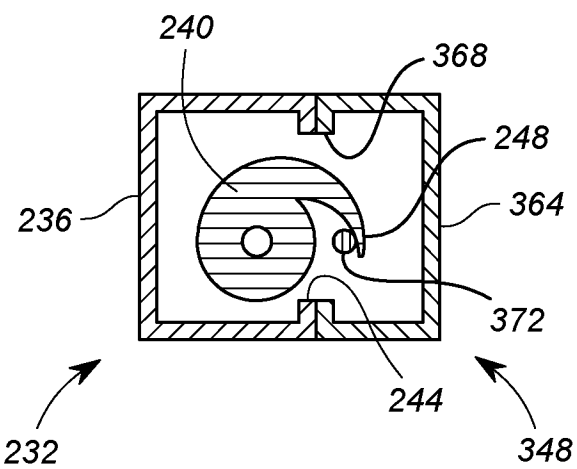
FIG. 6B depicts a cross-sectional view of the engagement element of FIG. 4A, in the engaged position, and the mating engagement element of FIG. 6A.
Figure 6A:
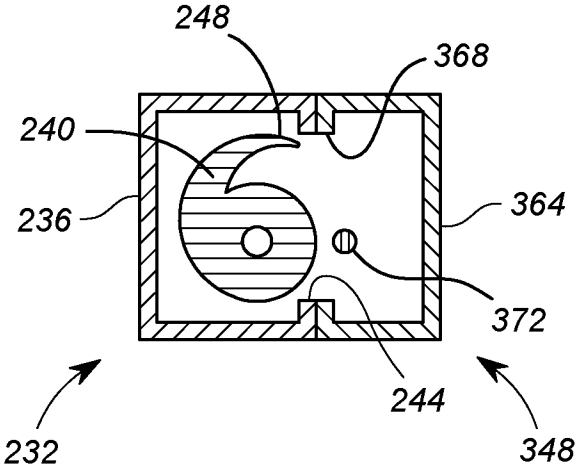
FIG. 6A depicts a cross-sectional view of the engagement element of FIG. 4A, in the unengaged position, and a mating engagement element of the foot end of the reusable metal casket of FIGS. 1A and 1B.

When the foot end 128 is in the first position, the first foot edge surface 328 abuts the first side edge surface 212, and the mating engagement element 348 is aligned with the engagement element 232 such that the frame 364 of the first foot portion 280 abuts the frame 236 of the first side 124. Thus, as shown in FIGS. 6A and 6B, the open side 368 of the frame 364 is aligned with the open side 244 of the frame 236, and the hook 240 is aligned with the pin 372. Accordingly, rotation of the hook 240 from the unengaged position (shown in FIG. 6A) to the engaged position (shown in FIG. 6B) rotates the tip 248 of the hook 240 around the pin 372, thereby engaging the engagement element 232 with the mating engagement element 348. Conversely, rotation of the hook 240 from the engaged position (shown in FIG. 6B) to the unengaged position (shown in FIG. 6A) rotates the tip 248 of the hook 240 away from the pin 372, thereby unengaging the engagement element 232 from the mating engagement element 248.

As shown in FIGS. 1B and 3, one of the biasing arrangements 340 is positioned between the first side panel 202 and the corresponding rail 260 and between the first foot portion 280 and the corresponding fin support 360, and the other of the biasing arrangements 340 is positioned between the second side panel 216 and the corresponding rail 260 and between the second foot portion 292 and the corresponding fin support 360. Accordingly, the biasing arrangements 340 do not interfere with use of the casket 100 when the foot end 128 is in the first position or the second position.

In use, the tray 102 supporting a body of the deceased is securely retained within the casket interior 110 when the foot end 128 of the casket 100 is in the first position, and is able to be inserted into and removed from the casket interior 110 via the foot end 128 when the foot end 128 is in the second position. To facilitate securely retaining the tray 102 within the casket interior 110, each of the first side 120 and the second side 124 includes an engagement element 232 configured to engage with mating engagement elements 348 of the foot end 128 when the foot end 128 is in the first position.

To enable insertion and removal of the tray 102 from the casket interior 110, the foot end 128 is movable to the second position. In particular, the hooks 240 of the engagement elements 232 are rotated to unengaged from the pins 372 of the corresponding mating engagement elements 348. The foot end 128 is then free to be rotated via the at least one hinge 336 relative to the bottom 112. Rotation of the foot end 128 separates the first foot edge surface 328 from the first side edge surface 212 and separates the second foot edge surface 332 from the second side edge surface 228. Further rotation of the foot end 128 removes the fins 344 and the fin supports 360 from between the rails 260 and the first and second sides 120, 124. Rotation of the foot end 128 relative to the bottom 112 is limited by the biasing arrangements 340 to prevent the foot end 128 from contacting the bottom 112 of the casket 100. Once the foot end 128 is in the second position, the tray 102 can be inserted or removed from the casket interior 110.

To return the foot end 128 to the closed position, the foot end 128 is rotated back toward the first and second sides 120, 124, which is facilitated by the biasing arrangements 340. As the foot end 128 is rotated back toward the first and second sides 120, 124, the fins 344 and the fin supports 360 are inserted between the rails 260 and the first and second sides 120, 124. As the foot end 128 is further rotated back toward the first and second sides 120, 124, the first foot edge surface 328 is brought back into abutting contact with the first edge side surface 212 and the second foot edge surface 332 is brought back into abutting contact with the second side edge surface 228. Once the foot end 128 is in the first position, the hooks 240 of the engagement elements 232 are rotated to engage with the pins 372 of the corresponding mating engagement elements 348 to secure the foot end 128 in the first position.

The first and second head curves 168, 180 and the first and second foot curves 304, 316 provide smooth transitions, rather than sharp corners, at the edges of the casket 100. Additionally, because the curves 168, 180, 304, 316 are integrated into the head end 116 and the foot end 128, the head end 116 and the foot end 128 can be coupled to the first and second sides 120, 124 in a secure and aesthetically pleasing manner.

The foregoing detailed description of one or more embodiments of reusable metal casket has been presented herein by way of example only and not limitation. It will be recognized that there are advantages to certain individual features and functions described herein. Moreover, it will be recognized that various alternatives, modifications, variations, or improvements of the above-disclosed embodiments and other features and functions, or alternatives thereof, may be desirably combined into many other different embodiments, systems, or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A casket, comprising:

a base constructed primarily of a metal material, the base including:

a bottom;

a head end fixedly coupled to the bottom, the head end including a head panel defining a substantially planar head panel surface;

a first side fixedly coupled to the bottom and to the head end, the first side including a first side panel defining a first side surface that is substantially perpendicular to the head panel surface;

a second side fixedly coupled to the bottom and to the head end, the second side including a second side panel defining a second side surface that is substantially parallel to the first side surface; and a foot end rotatably coupled to the bottom and including:

a foot panel defining a substantially planar foot panel surface;

a first foot portion defining a substantially planar first foot portion surface, the first foot portion projecting substantially perpendicularly from the foot panel such that the first foot portion surface is substantially perpendicular to the foot panel surface and parallel to the first side surface; and a second foot portion defining a substantially planar second foot portion surface, the second foot portion projecting substantially perpendicularly from the foot panel such that the second foot portion surface is substantially perpendicular to the foot panel surface and parallel to the second side surface; and a lid constructed primarily of a metal material, the lid having a head portion and a foot portion rotatably coupled to one of the first and second sides, wherein:

the foot end is movable between a first position and a second position, in the first position, the foot panel surface is parallel to the head panel surface, in the second position, the foot panel surface is not parallel to the head panel surface, and when the foot end is in the first position, the first foot portion surface is coplanar with the first side surface and the second foot portion surface is coplanar with the second side surface.

2. The casket of claim 1, wherein:

the head end further includes a first head portion defining a substantially planar first head portion surface and a second head portion defining a second head portion surface, and the first and second head portion surfaces are parallel to the first and second side surfaces.

3. The casket of claim 1, wherein the foot end includes a first corner disposed between the first foot portion and the foot panel and a second corner disposed between the second foot portion and the foot panel.

4. The casket of claim 3, wherein:

the first foot portion surface and the first side surface define a seam therebetween, and the first foot portion extends from the seam to the first corner.

5. The casket of claim 1, wherein:

the foot end includes a curved portion between the foot panel surface and the first foot portion surface and between the foot panel surface and the second foot portion surface.

6. The casket of claim 1, further comprising:

a first engagement element arranged on the first foot portion surface and a second engagement element arranged on the second foot portion surface;

a third engagement element arranged on the first side surface and configured to selectively engage with the first engagement element; and a fourth engagement element arranged on the second side surface and configured to selectively engage with the second engagement element.

7. The casket of claim 6, wherein:

each of the third and fourth engagement elements includes an operating element which is operated to selectively engage with the first and second engagement elements, respectively.

8. The casket of claim 7, wherein each of the operating elements includes a hook which is rotated to selectively engage with the first and second engagement elements, respectively.

9. The casket of claim 1, wherein:

the first side includes a further first side surface that is parallel to the first side surface and the second side includes a further second side surface that is parallel to the second side surface, the foot end includes a first fin extending parallel to the first foot portion surface and a second fin extending parallel to the second foot portion surface, and the first fin is received between the first side surface and the further first side surface and the second fin is received between the second side surface and the further second side surface when the foot end is in the first position.

10. The casket of claim 1, further comprising:

a biasing member fixedly coupled to the bottom and to the foot end and configured to bias the foot end toward the first position.

11. The casket of claim 1, wherein the foot panel surface, the first foot portion surface, and the second foot portion surface face an interior of the base.

12. A casket, comprising:

a base constructed primarily of a metal material, the base including:

a bottom;

a head end fixedly coupled to the bottom, the head end including a planar head panel surface;

a first side fixedly coupled to the bottom and to the head end, the first side including a planar first side surface that is perpendicular to the head panel surface;

a second side fixedly coupled to the bottom and to the head end, the second side including a planar second side surface that is perpendicular to the head panel surface; and a foot end including:

a planar foot panel surface, the foot end rotatably coupled to the bottom and movable between a first position, whereat the foot panel surface is parallel to the head panel surface, and a second position, whereat the foot panel surface is not parallel to the head panel surface;

a first foot portion surface and a second foot portion surface that are perpendicular to the foot panel surface; and a first curved surface extending between the foot panel surface and the first foot portion surface and a second curved surface extending between the foot panel surface and the second foot portion surface, wherein the planar foot panel surface, the first foot portion surface, the second foot portion surface, the first curved surface and the second curved surface define a portion of an interior surface of the base; and a lid constructed primarily of a metal material, the lid having a head portion and a foot portion rotatably coupled to one of the first and second sides, the lid configured to cover interior surface of the base.

13. The casket of claim 12, wherein, when the foot end is in the first position, the first foot portion surface is coplanar with the first side surface and the second foot portion surface is coplanar with the second side surface.

14. The casket of claim 12, wherein:

the head end further includes:

a first head portion surface and a second head portion surface that are perpendicular to the head panel surface; and a third curved surface extending between the head panel surface and the first head portion surface and a fourth curved surface extending between the head panel surface and the second head portion surface.

15. The casket of claim 14, wherein the first head portion surface is coplanar with the first side surface and the second head portion surface is coplanar with the second side surface.

16. The casket of claim 12, further comprising:

a first engagement element arranged on the first foot portion surface and a second engagement element arranged on the second foot portion surface;

a third engagement element arranged on the first side surface and configured to selectively engage with the first engagement element; and a fourth engagement element arranged on the second side surface and configured to selectively engage with the second engagement element.

17. The casket of claim 16, wherein the first side surface and the second side surface face toward one another.

18. The casket of claim 16, wherein each of the third and fourth engagement elements includes an operating element which is operated to selectively engage with the first and second engagement elements, respectively.

19. The casket of claim 18, wherein each of the operating elements includes a hook which is rotated to selectively engage with the first and second engagement elements, respectively.

* * * * *